US005489892A

United States Patent [19]

Imuro et al.

[11] Patent Number: 5,489,892

[45] Date of Patent: Feb. 6, 1996

[54] INFRARED HUMAN DETECTOR NOT BARRED BY AN INTERVENING OBSTRUCTION

[75] Inventors: Yoshihiro Imuro; Hiroyuki Tomooka, both of Shiga, Japan

[73] Assignee: Optex Co., Ltd., Shiga, Japan

[21] Appl. No.: 350,289

[22] Filed: Dec. 6, 1994

[30] Foreign Application Priority Data

Dec. 21, 1993 [JP] Japan ..... 5-321537

[51] Int. Cl.[6] ..... G08B 13/193; G08B 29/00

[52] U.S. Cl. ..... 340/567; 250/338.1; 250/340; 250/DIG. 1

[58] Field of Search ..... 340/567; 250/DIG. 1, 250/338.1, 340

[56] References Cited

U.S. PATENT DOCUMENTS 4,242,669 12/1980 Crick ..... 340/567

5,091,648 2/1992 Owers et al. ..... 340/567

*Primary Examiner*—Glen Swann

*Attorney, Agent, or Firm*—Panitch Schwarze Jacobs & Nadel

[57] ABSTRACT

An intruder detection system for senses infrared radiated by an intruder through a window-pane and detecting the intrusion through the reception of an output from the infrared sensors. The system includes a light emitter for projecting infrared rays toward a detection area and a light acceptor for receiving at least part of the infrared rays projected by the light emitter through an obstruction detection optical path. The light emitter and the light acceptor are located on opposite sides of the window-pane.

2 Claims, 8 Drawing Sheets

Fig. 2(A)
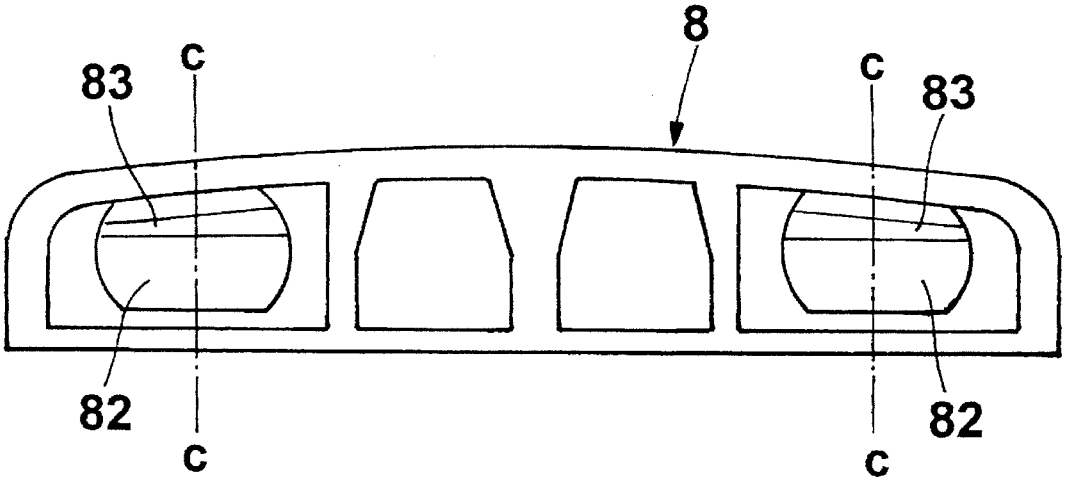
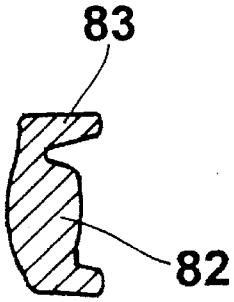
Fig. 2(B)

INFRARED HUMAN DETECTOR NOT BARRED BY AN INTERVENING OBSTRUCTION

FIELD OF THE INVENTION

The present invention relates generally to an intruder detection system, and more particularly to a passive type intruder detection system for securing detection even if any obstruction intervenes between the detector and an intruder.

BACKGROUND OF THE INVENTION

An intruder detection system is commonly provided with a light receiving window having a light transmissive pane (hereinafter referred to as "window-pane") through which an acceptor receives infrared ray radiated by an intruder passing through a detection area. It may happen that an intruder who knows the presence of a detection system deliberately covers the window with a non-transmissive material such as cloth so as to disable the detection system. Such an obstruction may inadvertently happen owing to wind or any other cause. As a result, an alarm will fail, an automatic door will not open, or no signal is transmitted to a contract security service.

In order to obviate an obstruction to the detection system, Japanese Patent Publication Kokai No. 4-190500 discloses an intruder detection system which is additionally provided with a light emitter spaced from the window. The light emitter projects light at intervals. The detection system also incorporates a checker for receiving the light from the light emitter in synchronism with the emission of light. This system is disadvantageous in requiring extra equipment such as a light-emitter and a checker, thereby complicating the structure and increasing the production cost.

Japanese Patent Publication Kokai No. 2-287278 teaches the provision of a light emitter adjacent to a light acceptor within the window frame so as to know the presence of a probable obstacle by detecting any increase in the light reflection upon the obstacle. However, if the cover is black cloth or any other light absorptive material, this anti-obstruction system will not function because of detecting no increase in the reflecting light.

A further proposal identified by International Publication No. WO 88/03301 discloses a burglar sensor having a light emitter provided outside the window so as to monitor any increase in a reflecting light upon a probable cover or caused by any other obstructive act. This device has the same disadvantage as the last-mentioned system, in that if the used cover is black, the amount of the reflecting light do not increase, thereby failing to detect the presence of malicious covering.

There can be two kinds of obstruction; one is to cover the window directly with a non-transmissive object, and the other is to place an obstructive covering between the light emitter and the light acceptor, at some distance from the window.

SUMMARY OF THE INVENTION

Accordingly, the present invention is to provide a passive type intruder detection system capable of securing the detection of an intruder even if the window is deliberately or inadvertently covered with a non-transmissive material.

According to the present invention, there is provided an intruder detection system for sensing infrared radiated by a human intruder through a window-pane and detecting the intrusion through the reception of an output from the infrared sensor, the system including a light emitter for projecting infrared ray toward a detection area, and a light acceptor for receiving at least part of the infrared ray projected by the light emitter through an obstruction detection optical path, the light emitter and the light acceptor being located in opposite positions with respect to the window.

Even if a light absorptive cover is placed directly on the window-pane or at a distance therefrom, the intrusion detection is secured.

BRIEF DESCRIPTION OF THE DRAWINGS

FIG. 2(A) is a front view showing a prism lens on an enlarged scale shown in FIG. 1;

FIG. 2(B) is a cross-sectional view taken along the line c—c in FIG. 2(A);

DETAILED DESCRIPTION OF THE PREFERRED EMBODIMENT

Figure 1:
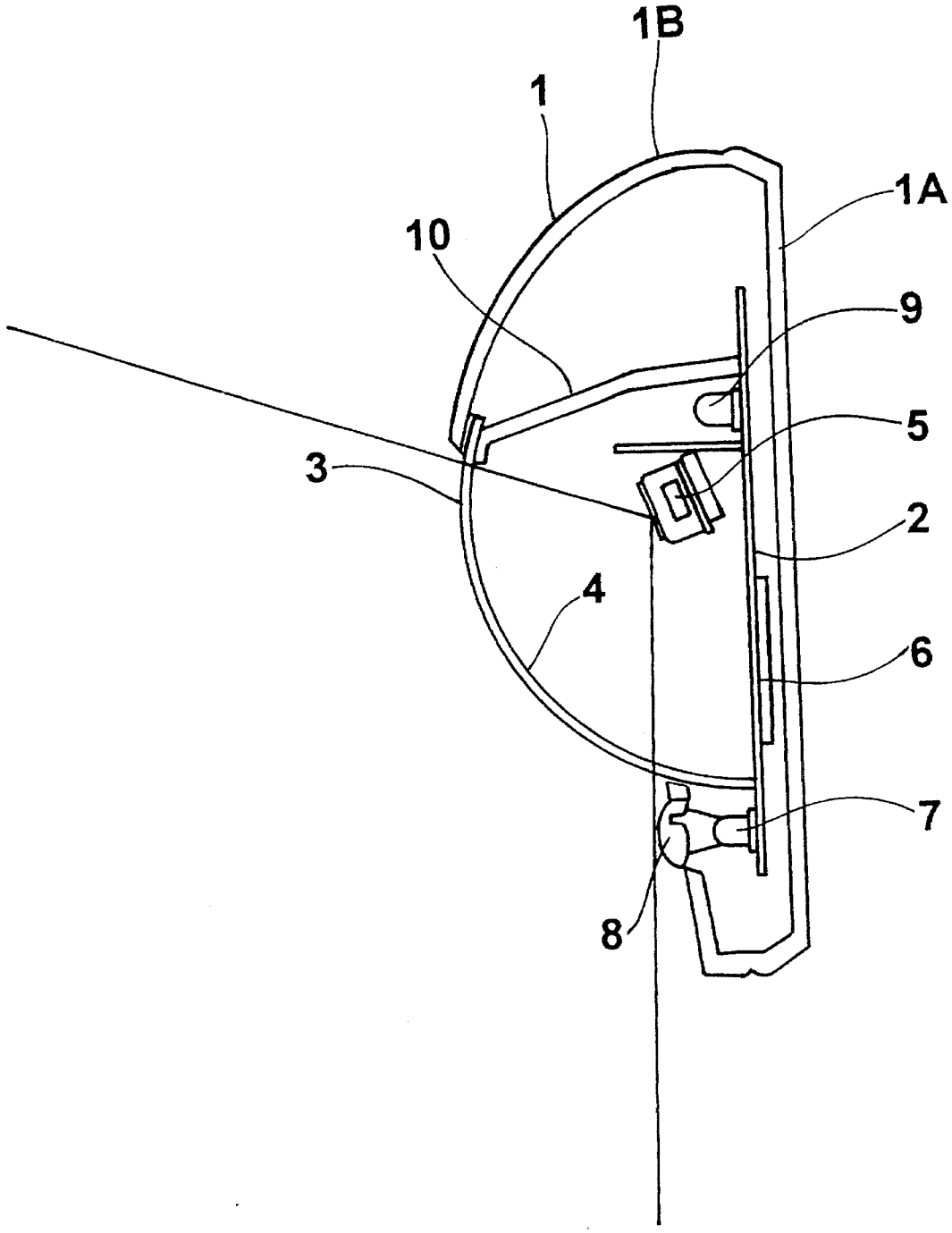
FIG. 1 is a view, vertically in cross-section, of an optical section incorporated in the intrusion detection system according to the present invention.
Figure 3:
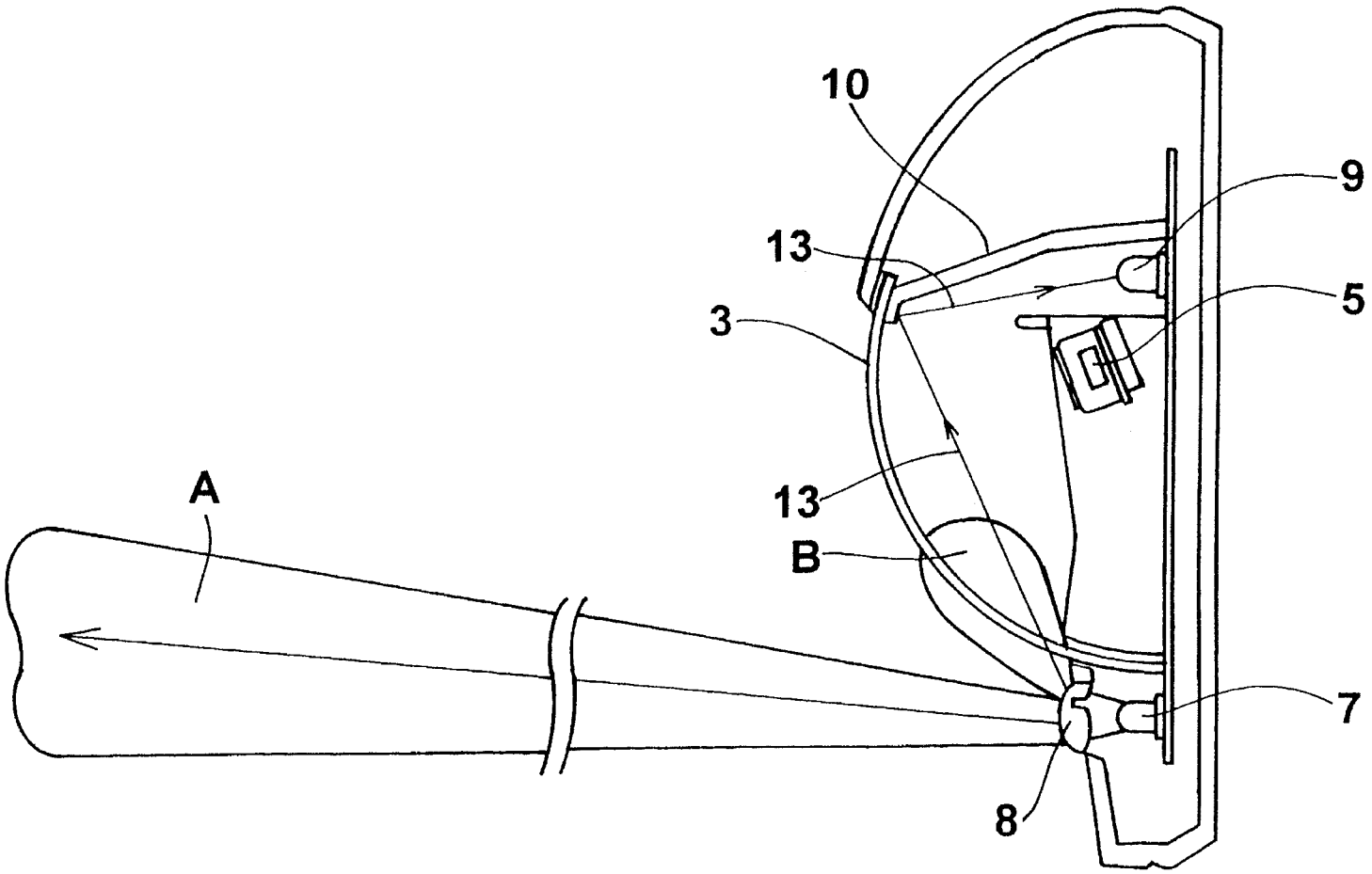
FIG. 3 is an explanatory view exemplifying an optical action performed by the embodiment shown in FIG. 1.

Referring to FIGS. 1 to 3, the exemplary detection system is designed to be placed on a wall. A housing 1 includes a back plate 1A placeable on a wall and an eaves-like plate 1B projecting forward. The housing 1 is provided with a mounting plate 2 in parallel with the back plate 1A, and with a window-pane 3 made of a polyethylene sheet having a Fresnel lens 4 formed on the back thereof. A PIR (passive infrared photosensor) sensor is disposed at a focusing position of the Fresnel lens 2. The window-pane 3, the Fresnel lens 4 and the PIR sensor 5 constitute an intruder detection system.

A light emitter 7 which consists of an infrared emitting diode is Fixed to a lower end of the mounting plate 2, and a prism lens 8 disposed in front of the emitter 7. A light acceptor 9 which consists of an infrared receiving diode is fixed to an upper end of the mounting plate 2. The reference numeral 10 designates a reflecting mirror which reflects light from the light emitter 7 and allows it into the acceptor 9 as shown in FIG. 3.

As shown in FIG. 2(A), the prism lens 8 includes a lens portion 82 for allowing light to pass straight therethrough and a prism portion 83 for allowing light to diagonally deflect upward.

Referring to FIG. 3, the optical action of the exemplary system will be described:

If an intruder passes through a detection area, the infrared ray radiated by the intruder passes through the window-pane 3, and is focused by the Fresnel lens 2. Then it is received by the PIR sensor 5 which generates a signal. The light emitter 7 and prism lens 8 project light both in an open optical path (A) and a closed optical path (B). If no obstructive object intervenes in the optical path (A), the light is projected into the open optical path (A) and disperses without being received by the acceptor 9. Part of the light from the light emitter 7 is projected into the closed optical path (B), and after reflecting upon the mirror 10, it is incident to the acceptor 9. The path from the light emitter 7 to the light acceptor 9 through the reflecting mirror 10 constitutes an obstacle detection optical path 13, which are indicated by the arrows.

Figure 4:
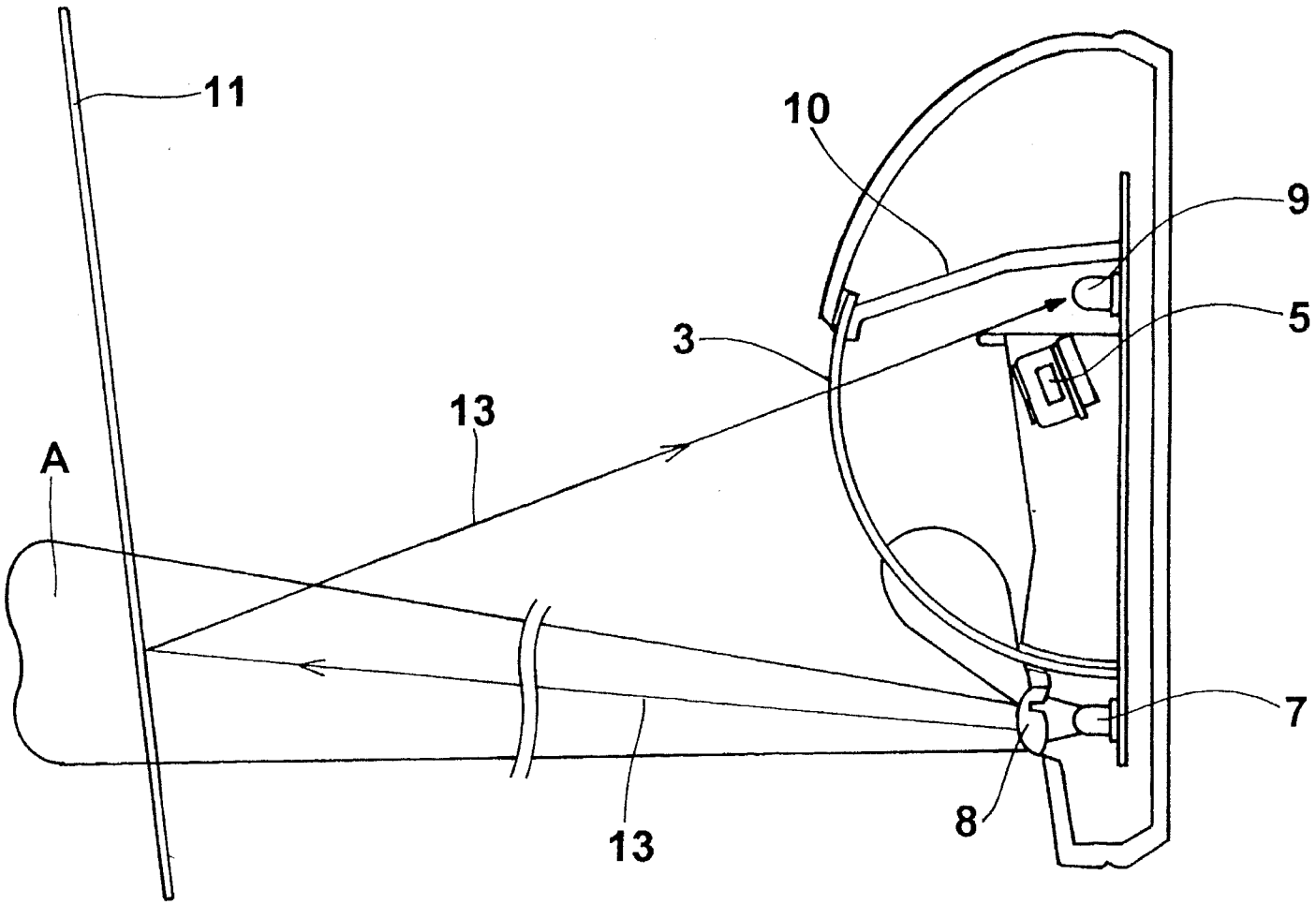
FIG. 4 is an explanatory view exemplifying an optical action performed by an obstructive act.

Referring to FIG. 4, a counteraction against an obstructive act will be described:

An obstructive object 11 is placed at a distance from the window-pane 3 so that the PIR sensor 5 may fail to receive the infrared radiated by an intruder passing through the detection area. The light in the open optical path (A) reflects upon the obstructive object 11, and part of it is received by the acceptor 9, thereby increasing the amount of light received in the acceptor 9.

Figure 5:
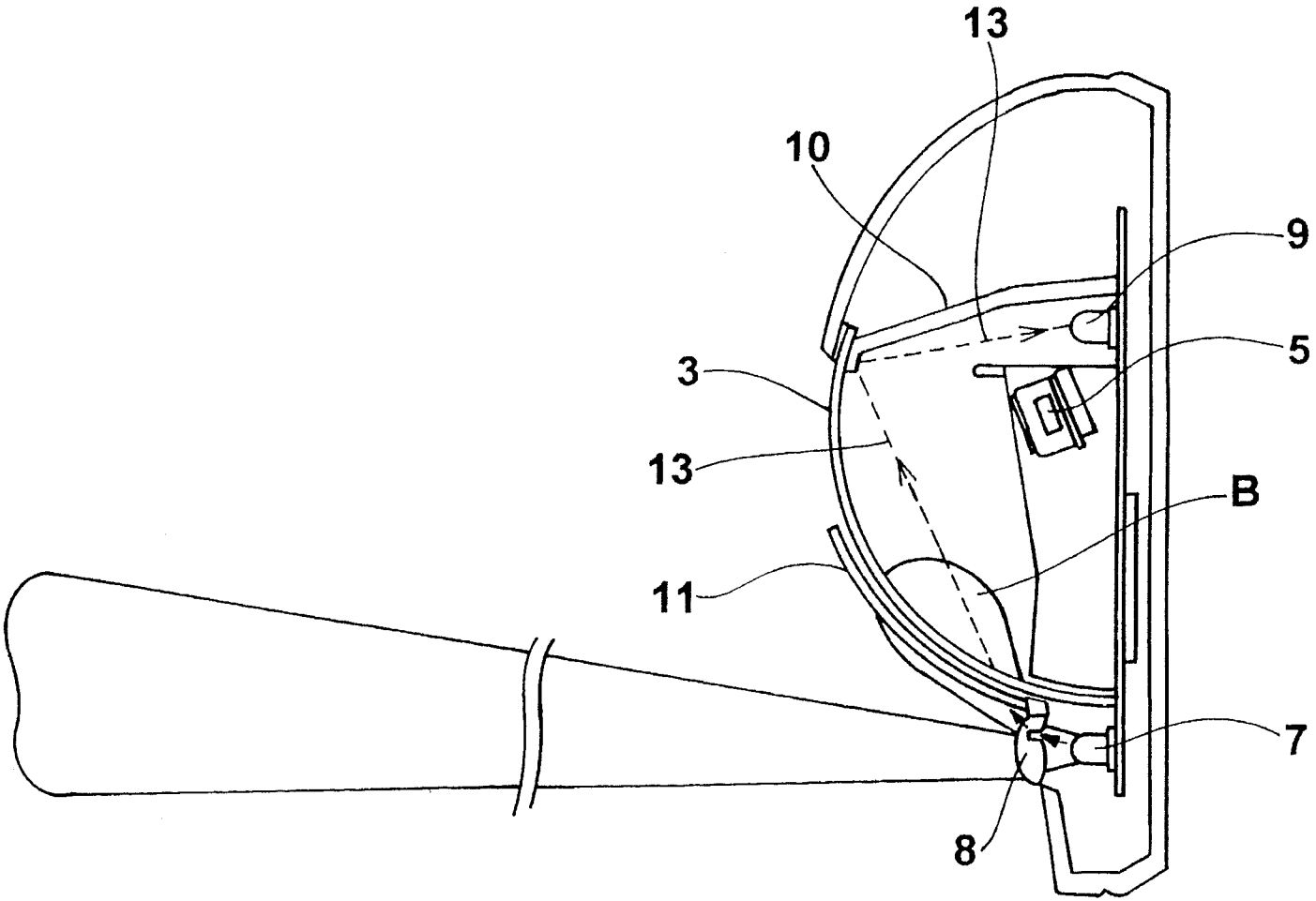
FIG. 5 is an explanatory view exemplifying an optical action performed by another type of obstructive act.

Referring to FIG. 5, a counteraction in response to another type of obstructive act intended to directly cover the window-pane 3:

An obstructive cover 11 is placed directly on the window-pane 3, so that the PIR sensor 5 fails to receive infrared radiated by an intruder passing through the detection area. The obstructive cover 11 also blocks the closed optical path (B), thereby decreasing the amount of light received in the acceptor 9.

Figure 6:
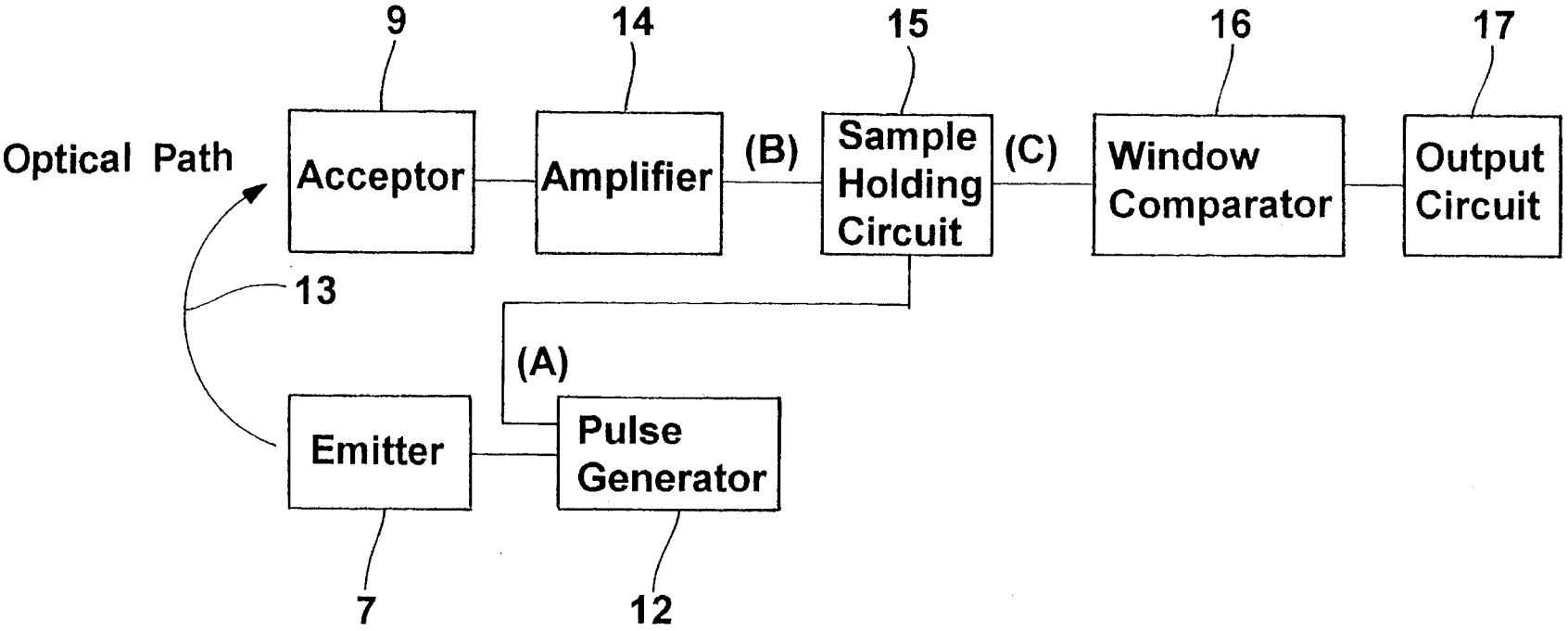
FIG. 6 is a block diagram showing an electric circuit for detecting an obstructive act.

Referring to FIG. 6, the light emitter 7 emits light in response to an output of a pulse generator 12. The interval of time T is preferably 0.01 to 10 seconds. A short period of time T is not always helpful to increase the accuracy of detection but only results in the wasting of electricity. A long period of time T is disadvantageous in that if an intruder stole into the site immediately after the window is covered, the intruder cannot be detected by the PIR sensor 5. In this case, an alternative way is to inform a contract security service of the detection of an obstructive act as soon as it is detected. The acceptor 9 receives part of the light from the light emitter 7 that passes through the obstacle detection optical path 13. The output of the acceptor 9 is stepped up by an amplifier 14, and a peak value output of the amplifier 14 is held by a sample holding circuit 15 which is operated in synchronism with the pulse generator 12 and the pulse output. A window comparator 16 removes components existing between those at low level (Th-L) and at high-level (Th-H)

In this way, the window comparator 16 outputs signals when any component above and below these levels are input. An output circuit 17 outputs an obstacle detection signal in response to the outputs of the window comparator 16.

Figure 7:
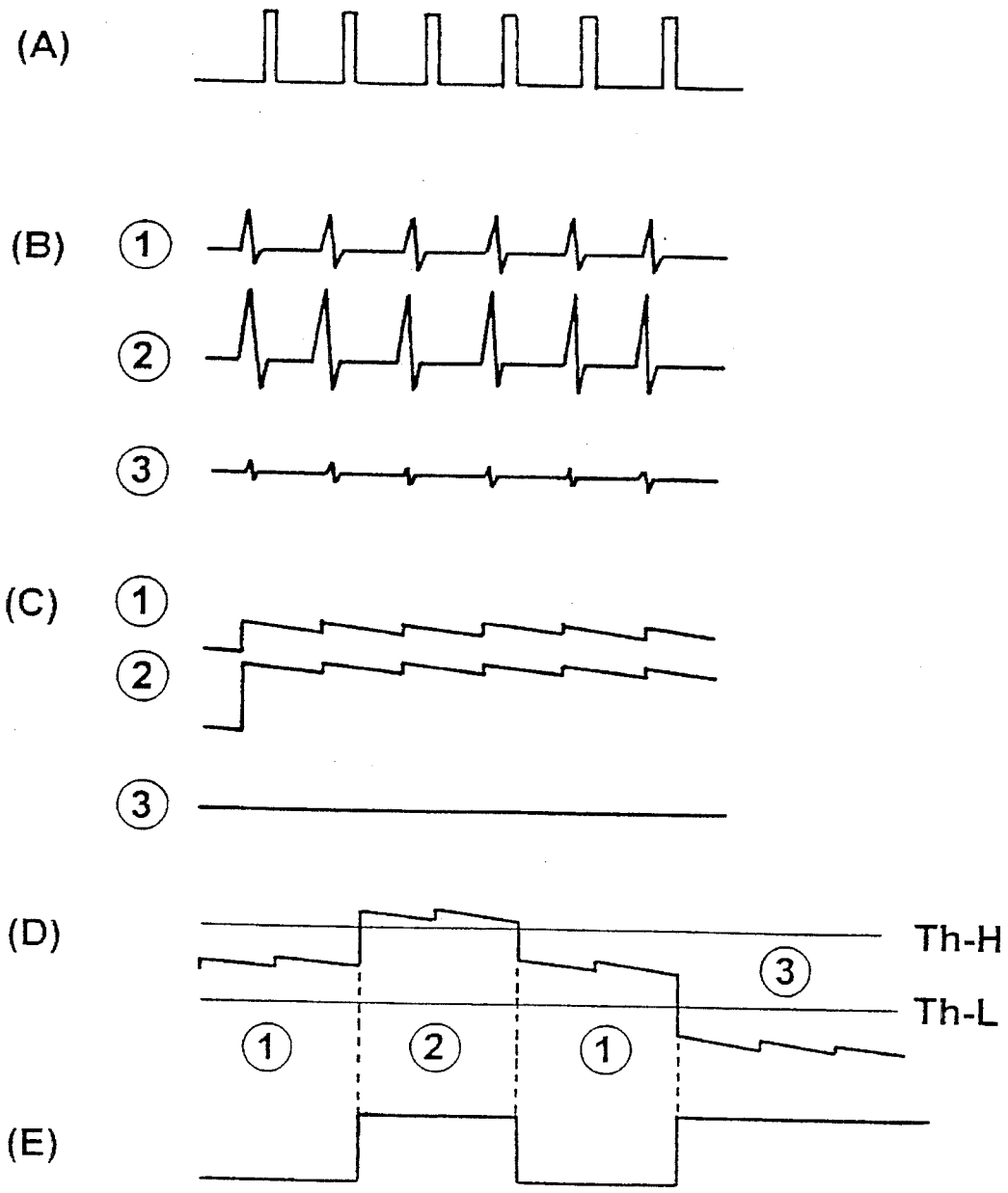
FIGS. 7(A) to 7(E) are diagrammatic views showing the actions of the electric circuit shown in FIG. 6.

Referring to FIG. 7, various waveforms of signals will be explained:

FIG. 7(A) shows a waveform of the output of the pulse generator 12, and FIG. 7(B) shows that of the amplifier 14 wherein the waveform indicated by 1 is obtained when no obstruction is present, that indicated by 2 is obtained when an incident light increases owing to the addition of a reflecting light from an obstacle object (FIG. 4), and that indicated by 3 is obtained when an incident light decreases owing to the presence of an obstacle (FIG. 4). FIG. 7(C) shows the waveforms of outputs of the sample holding circuit 15, wherein those indicated by 1, 2, and 3 correspond to those indicated by 1, 2, and 3.

FIG. 7(D) shows the waveforms of signals input to the window comparator 16 wherein the levels Th-H and Th-L are shown for the upper limit and lower limit. FIG. 7(E) shows the waveforms of outputs of the window comparator 16 in correspondence to the states shown in FIG. 7(D).

Figure 8:
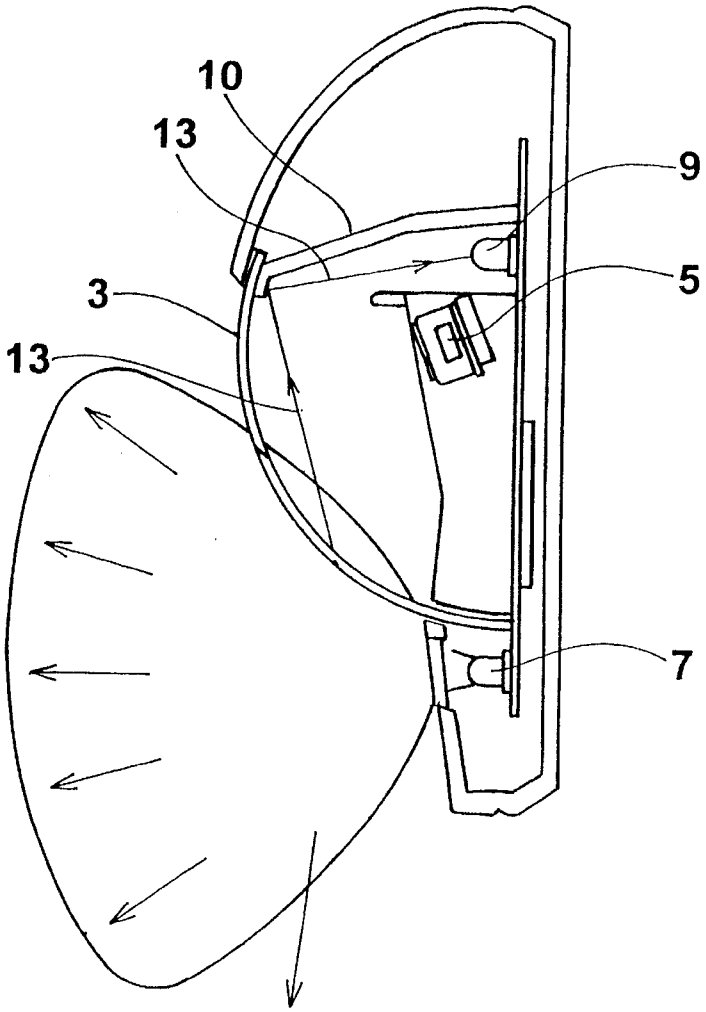
FIG. 8 is a view, vertically in cross-section, of another optical section showing an action thereof.

FIG. 8 shows another example of the embodiment which is characterized by the fact that no open optical path or closed optical path is separately provided unlike the example shown in FIG. 3 but instead of them, a relatively wide path is singly used without having the prism lens 8. The wide range of path covers a space from the detection area up to the surface of the window-pane 3. Part of the upward light from the light emitter 7 is incident to the acceptor 9 when no obstruction is placed.

What is claimed is:

1. An intruder detection system for sensing infrared radiated by a human intruder through a window-pane and detecting the intrusion through the reception of an output from an infrared sensor, the system comprising a light emitter provided outside the window-pane so as to project infrared rays toward a detection area, a light acceptor provided inside the window-pane, the light emitter and the light acceptor being optically connected to each other by an obstruction detection optical path, the system further comprising a prism lens provided in front of the light emitter so as to produce an open optical path and a closed optical path.

2. An intruder detection system for sensing infrared radiated by a human intruder through a window-pane and detecting the intrusion through the reception of an output from an infrared sensor, the system comprising a light emitted provided inside the window-pane so as to project infrared rays toward a detection area, a light acceptor provided outside the window-pane, the light emitter and the light acceptor being optically connected to each other by an obstruction detection optical path.

* * * * *